US010016801B2

(12) United States Patent
Homma et al.

(10) Patent No.: US 10,016,801 B2
(45) Date of Patent: Jul. 10, 2018

(54) METHOD OF MANUFACTURING A SUB-MUFFLER OUTER CYLINDER

(71) Applicant: Toyota Jidosha Kabushiki Kaisha, Toyota (JP)

(72) Inventors: Hideki Homma, Inuyama (JP); Akiyoshi Yamamoto, Nisshin (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 341 days.

(21) Appl. No.: 14/723,750

(22) Filed: May 28, 2015

(65) Prior Publication Data

US 2015/0343509 A1 Dec. 3, 2015

(30) Foreign Application Priority Data

May 30, 2014 (JP) ..... 2014-112297

(51) Int. Cl.
*B21D 5/14* (2006.01)
*B21D 53/88* (2006.01)
(Continued)

(52) U.S. Cl.
CPC ..... *B21D 5/14* (2013.01); *B21C 37/185* (2013.01); *B21D 53/88* (2013.01);
(Continued)

(58) Field of Classification Search
CPC . B21C 37/0803; B21C 37/104; B21C 37/155; B21C 37/185; B21D 5/086; B21D 5/12; B21D 5/14; B21D 53/88; F01N 13/1894; F01N 13/1872; Y10T 29/49391; Y10T 29/49398; Y10T 29/5185
See application file for complete search history.

(56) References Cited

U.S. PATENT DOCUMENTS 2,674,294 A 4/1954 Ekberg
4,030,335 A * 6/1977 Allenspach ..... B21D 7/08 72/170
(Continued)

FOREIGN PATENT DOCUMENTS

CN 101327497 A 12/2008
GB 960708 6/1964
(Continued)

OTHER PUBLICATIONS

Office Action dated Oct. 17, 2016 in Chinese Patent Application No. 201510278122.1 (submitting Partial English translation only).

*Primary Examiner* — Sarang Afzali
(74) *Attorney, Agent, or Firm* — Oblon, McClelland, Maier & Neustadt, L.L.P.

(57) ABSTRACT

A manufacturing method of a sub-muffler outer cylinder is provided. The manufacturing method includes pushing one push roll toward two receive rolls, and then bending a plate-shape workpiece to form the sub-muffler outer cylinder made of a cylindrical-shaped body. A push-in amount in a part of the workpiece corresponding to a corner part of the cylindrical-shaped body is made larger than a push-in amount in a part of the workpiece corresponding to a side part of the cylindrical-shaped body to form the cylindrical-shaped body having a polygonal cross-sectional shape.

1 Claim, 20 Drawing Sheets

(51) Int. Cl.
*B21C 37/18* (2006.01)
*F01N 13/18* (2010.01)

(52) U.S. Cl.
CPC ..... *F01N 13/1872* (2013.01); *F01N 13/1894* (2013.01); *Y10T 29/494* (2015.01); *Y10T 29/49398* (2015.01)

(56) References Cited

U.S. PATENT DOCUMENTS

| | | | | |
|---|---|---|---|---|
| 4,735,076 | A * | 4/1988 | Zeugin ..... | B21D 5/14 72/307 |
| 7,536,891 | B2 * | 5/2009 | Weil ..... | B21D 5/08 72/166 |

FOREIGN PATENT DOCUMENTS

| | | | |
|---|---|---|---|
| JP | 55-57324 | A | 4/1980 |
| JP | 57-127524 | A | 8/1982 |
| JP | 62-179820 | A | 8/1987 |
| JP | 7-96330 | A | 4/1995 |
| JP | 2000-33426 | A | 2/2000 |
| JP | 2012-236207 | | 12/2012 |

* cited by examiner

METHOD OF MANUFACTURING A SUB-MUFFLER OUTER CYLINDER

INCORPORATION BY REFERENCE

This application is based upon and claims the benefit of priority from Japanese patent application No. 2014-112297, filed on May 30, 2014, the disclosure of which is incorporated herein in its entirety by reference.

BACKGROUND OF THE INVENTION

1. Field of the Invention

The present invention relates to a manufacturing method and a manufacturing device of a sub-muffler outer cylinder, and more particularly, to a manufacturing method and a manufacturing device of a sub-muffler outer cylinder to form a cylindrical-shaped body having a polygonal cross-sectional shape.

2. Description of Related Art

A tapered cylindrical-shaped body may be manufactured by bending a trapezoidal plate shape workpiece or a fan plate shape workpiece. In a process of bending the workpiece, a roll bending method is used, for example.

For example, Japanese Unexamined Patent Application Publication No. 2012-236207 discloses a roll bending method using three truncated cone-shaped rolls. By pushing a push roll toward two receive rolls while allowing a plate-shaped workpiece to pass between the push roll and the two receive rolls, it is possible to bend the workpiece to obtain a cone-cylinder shaped formed product having a predetermined taper angle. By performing a predetermined process on such a cone-cylinder shaped formed product, this product can be used, for example, as a sub-muffler outer cylinder used for a vehicle.

SUMMARY OF THE INVENTION

Incidentally, there has been demanded, for example, for a sub-muffler outer cylinder having a polygonal cross-sectional shape such as a trapezoidal shape. The present inventors first conceived a method of press-forming two plates using a press die, forming folded plates 80 and 90 as shown in FIG. 20, and further welding the folded plates 80 and 90 to form a sub-muffler outer cylinder having a polygonal cross-sectional shape. More particularly, a side part 80*a* of the plate 80 and a side part 90*a* of the plate 90 are welded and a side part 80*c* and a side part 90*c* are further welded. This method requires, however, a plurality of dedicated press dies depending on the cross-sectional shape of the sub-muffler outer cylinder, which increases the equipment cost.

The present invention has been made in view of the aforementioned circumstances and aims to provide a manufacturing method and a manufacturing device of a sub-muffler outer cylinder capable of manufacturing a cylindrical-shaped body having a polygonal cross-sectional shape even with low-cost equipment.

A manufacturing method of a sub-muffler outer cylinder according to the present invention includes pushing one push roll toward two receive rolls and then bending a plate-shape workpiece to form the sub-muffler outer cylinder made of a cylindrical-shaped body, in which an amount of a distance from the lowermost part of the push roll when the height of the lowermost part of the push roll is equal to the height of the uppermost part of the receive roll to the lowermost part of the push roll when the push roll is lowered (hereinafter, a push-in amount) in a part of the workpiece corresponding to a corner part of the cylindrical-shaped body is made larger than a push-in amount in a part of the workpiece corresponding to a side part of the cylindrical-shaped body to form the cylindrical-shaped body having a polygonal cross-sectional shape.

According to such a configuration, it is possible to manufacture a sub-muffler outer cylinder having a polygonal cross-sectional shape even with low-cost equipment.

Further, the push roll and the two receive rolls may each have a truncated cone side surface. According to such a configuration, it is possible to form a tapered cylindrical-shaped body having a polygonal cross-sectional shape.

Further, the push roll and the two receive rolls may each have a column side surface. According to such a configuration, it is possible to form a straight cylindrical-shaped body having a polygonal cross-sectional shape without having a taper angle.

On the other hand, a manufacturing device (e.g., roll bending device) of a sub-muffler outer cylinder according to the present invention includes one push roll, two receive rolls, a drive part (e.g., actuator, hydraulic cylinder) that pushes the push roll, and a controller (e.g., hydraulic controller) that controls the drive part, the manufacturing device pushing the push roll toward the receive rolls and then bending a workpiece to form the sub-muffler outer cylinder made of a cylindrical-shaped body, in which the controller controls a push-in amount in a part of the workpiece corresponding to a corner part of the cylindrical-shaped body to be larger than a push-in amount in a part of the workpiece corresponding to a side part of the cylindrical-shaped body.

According to such a configuration, it is possible to manufacture a sub-muffler outer cylinder having a polygonal cross-sectional shape with low-cost equipment.

According to the present invention, it is possible to provide a manufacturing method and a manufacturing device of a sub-muffler outer cylinder capable of forming a cylindrical-shaped body having a polygonal cross-sectional shape even with low-cost equipment.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

First Embodiment

Figure 9:
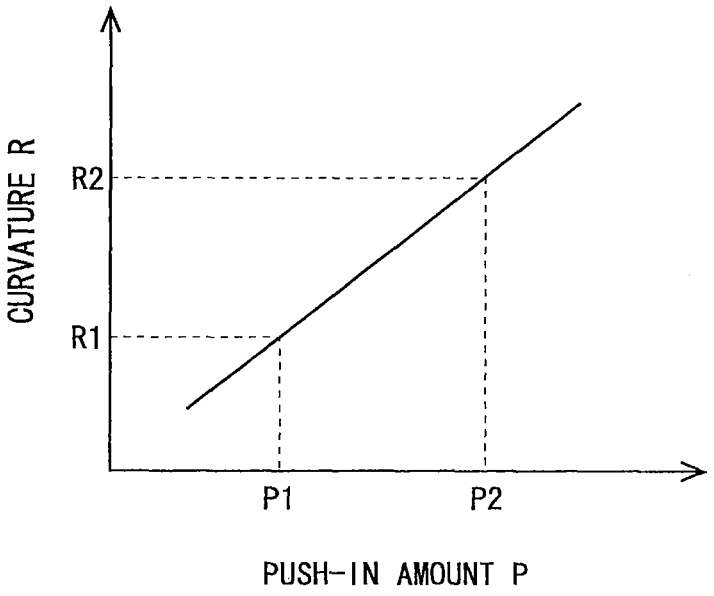
FIG. 9 is a curvature with respect to a push-in amount by a roll.
Figure 10:
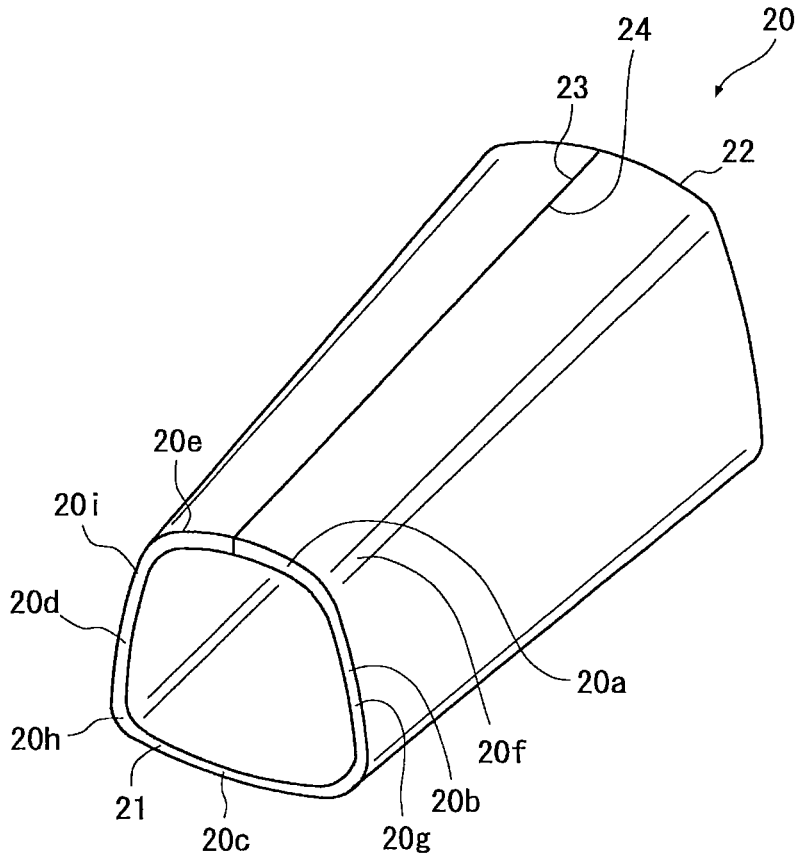
FIG. 10 is a perspective view of a cylindrical-shaped body.
Figure 11:
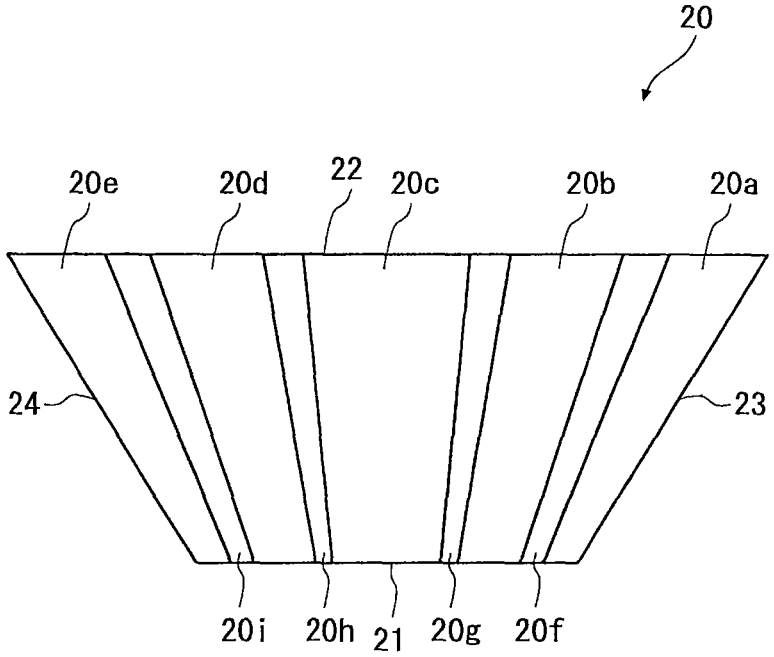
FIG. 11 is an expansion view of the cylindrical-shaped body.
Figure 12:
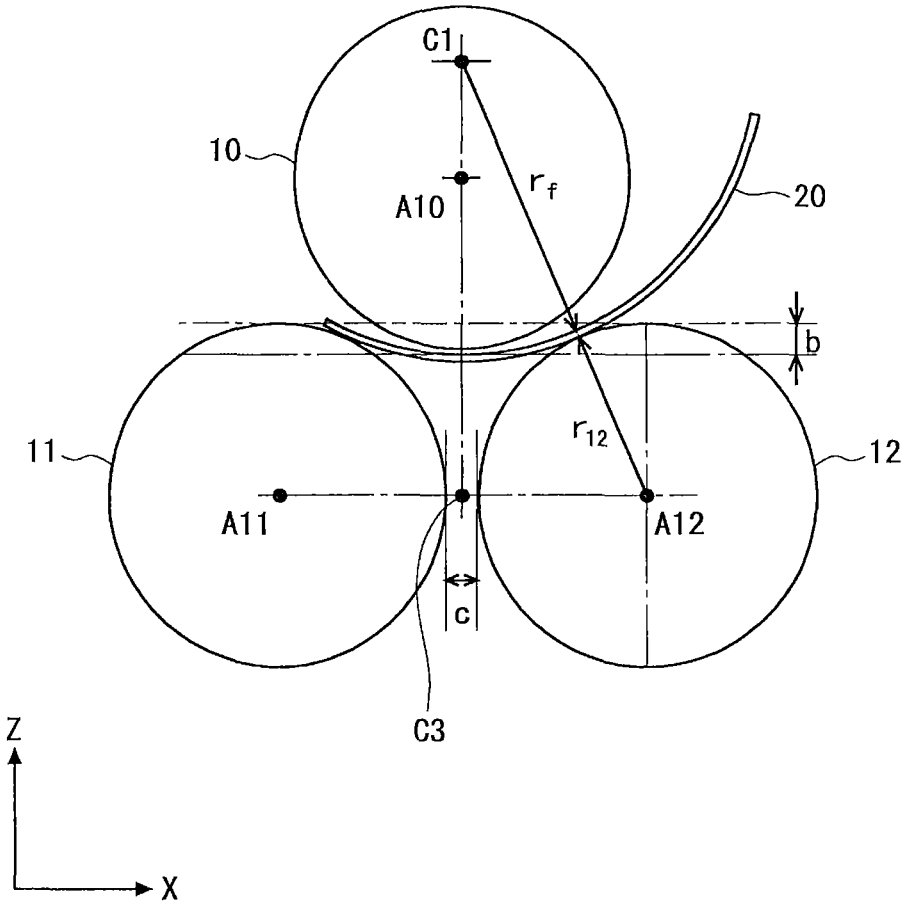
FIGS. 12 and 13 are schematic views for describing a relation among a dimension of a formed product, a radius of a roll, and the push-in amount by the roll.
Figure 13:
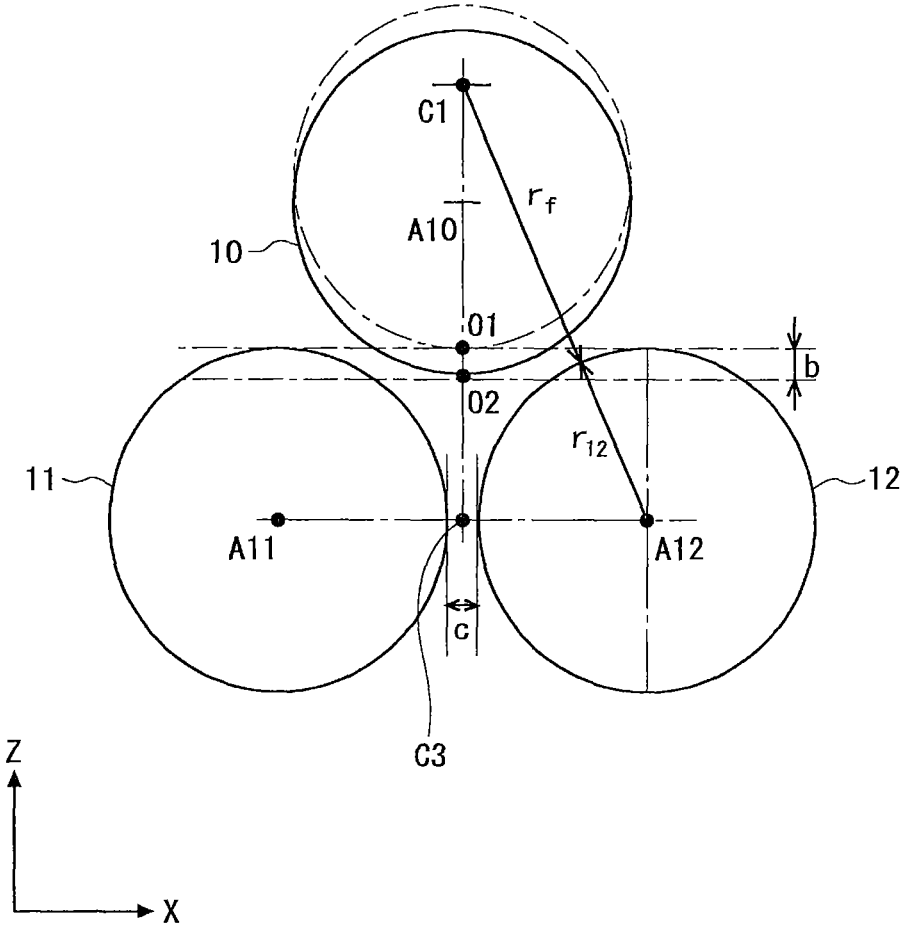
Figure 14:
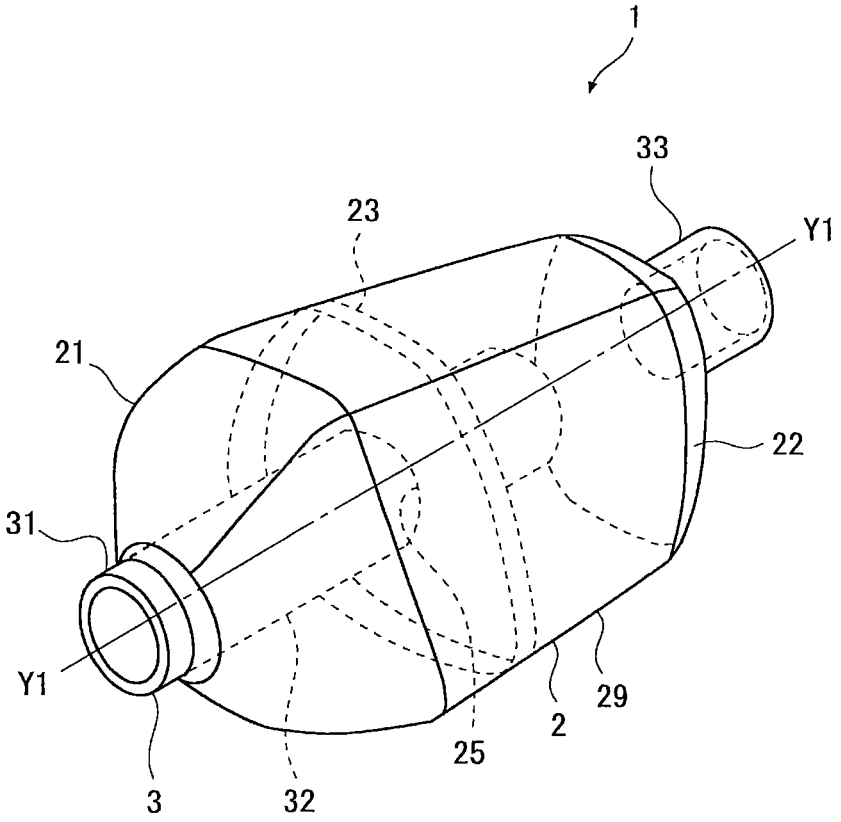
FIG. 14 is a perspective view of a sub-muffler.
Figure 15:
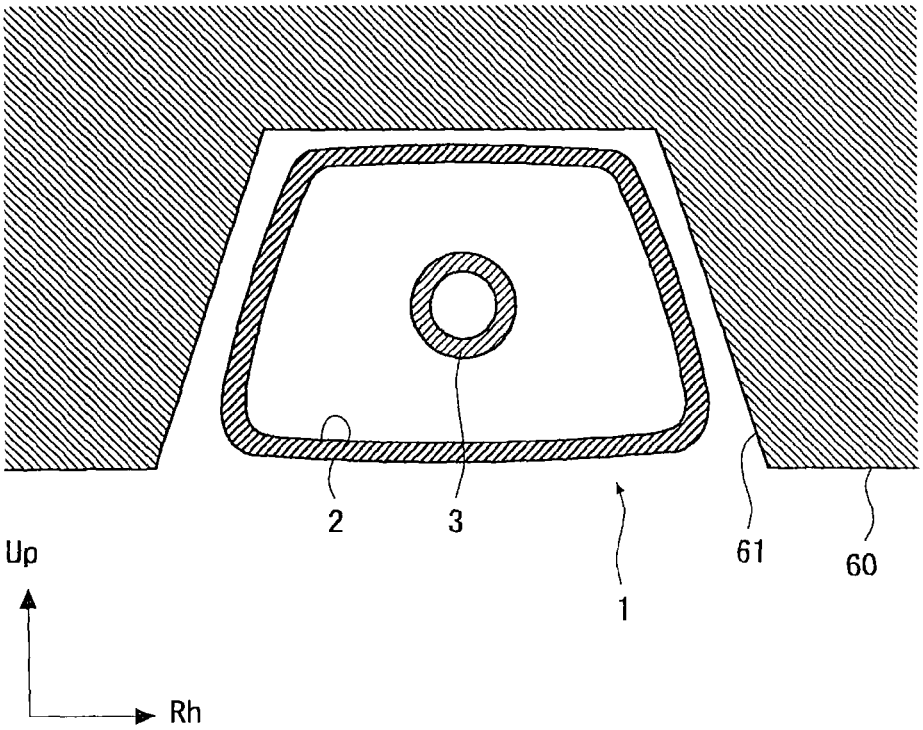
FIG. 15 is a schematic view showing the sub-muffler arranged at the underside of a vehicle.

With reference to FIGS. 1 to 15, a manufacturing method according to a first embodiment will be described. FIGS. 1 to 8 are schematic views showing processes of the manufacturing method according to the first embodiment. FIG. 9 is a curvature with respect to a push-in amount by a roll. FIG. 10 is a perspective view of a cylindrical-shaped body. FIG. 11 is an expansion view of the cylindrical-shaped body. FIGS. 12 and 13 are schematic views for describing a relation among a dimension of a formed product, a radius of a roll, and the push-in amount by the roll. FIG. 14 is a perspective view of a sub-muffler. FIG. 15 is a schematic view showing the sub-muffler arranged at the underside of a vehicle. In FIGS. 2-5, 7, and 8, for the sake of clarity of the drawings, bearing housings 13 and 14 (described later) and hydraulic cylinders 16 and 17 (described later) are not shown.

Figure 1:
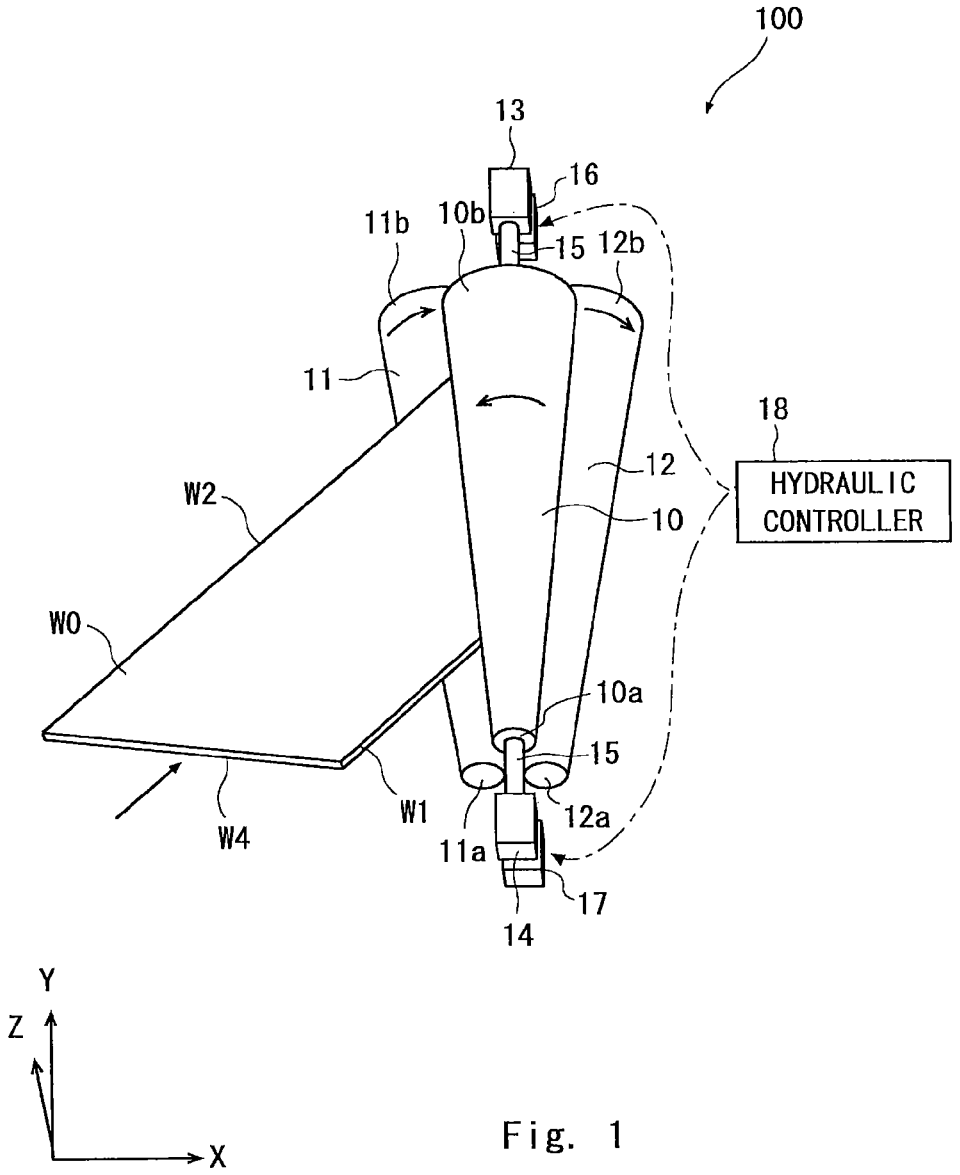
FIGS. 1 to 8 are schematic views showing processes of a manufacturing method according to a first embodiment.
Figure 2:
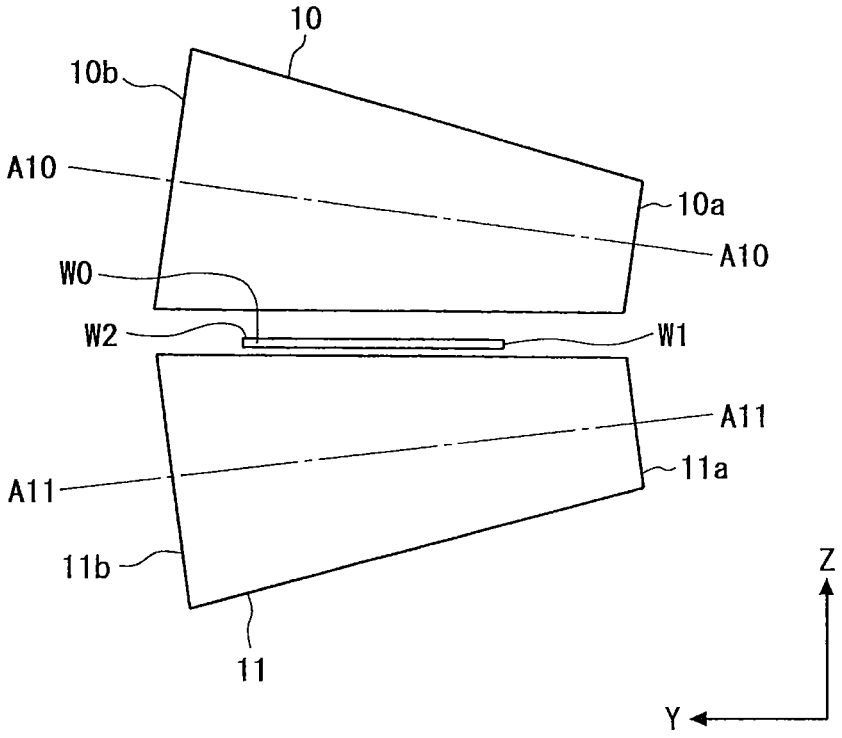
Figure 3:
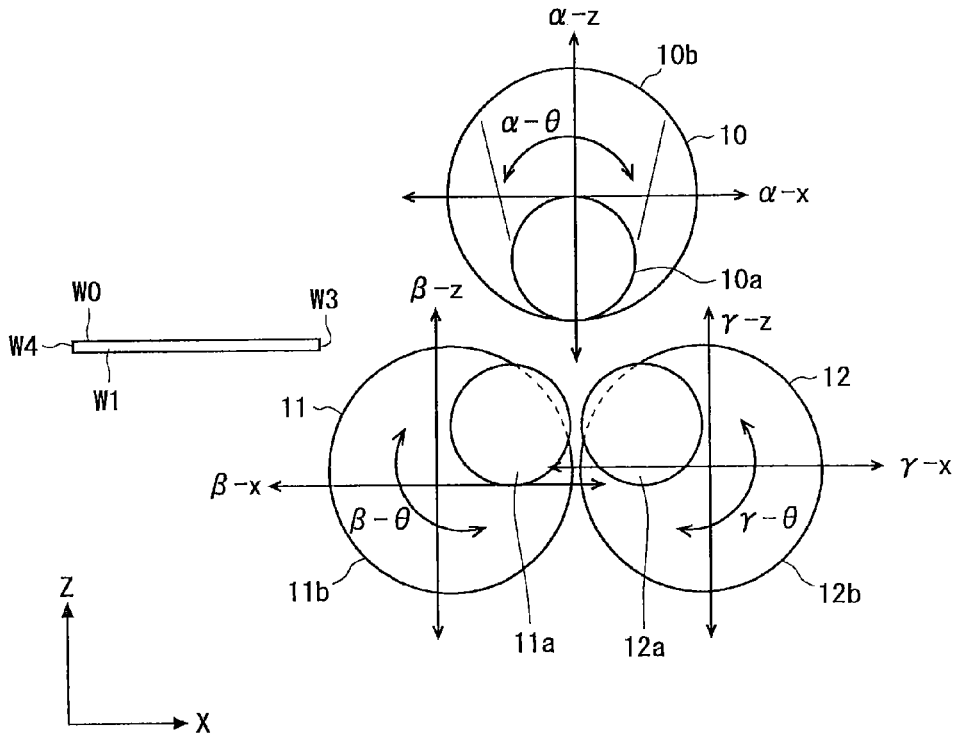

First, a manufacturing device used in the manufacturing method according to the first embodiment will be described. As shown in FIGS. 1-3, a roll bending device 100 (may be referred to as a manufacturing device of a sub-muffler outer cylinder) includes a push roll 10, receive rolls 11 and 12, bearing housings 13 and 14, and hydraulic cylinders 16 and 17 (may be referred to as drive parts).

The push roll 10 is a truncated cone that is supported by the bearing housings 13 and 14 via an axial member 15 and can be rotated around an axis A10. The rotation direction of the push roll 10 is represented by α-θ. One end part 10*b* of the push roll 10 has a diameter larger than that of the other end part 10*a*. The push roll 10 has a tapered shape so as to be squeezed from one end part 10*b* toward the other end part 10*a*. The side surface of the push roll 10 (may be referred to as a truncated cone side surface) is inclined to the axis at a predetermined taper angle. The push roll 10 can be moved along the α-z direction by the hydraulic cylinders 16 and 17 via the bearing housings 13 and 14 and the axial member 15. The push roll 10 can be lowered, for example, toward the receive rolls 11 and 12.

The receive rolls 11 and 12 are truncated cones that are supported by a supporting base (not shown) via an axial member (not shown) and can be respectively rotated around axes A11 and A12. The rotation directions of the receive rolls 11 and 12 are respectively represented by β-θ and γ-θ. One end part 11*b* of the receive roll 11 has a diameter larger than that of the other end part 11*a* and one end part 12*b* of the receive roll 12 has a diameter larger than that of the other end part 12*a*. The receive roll 11 has a tapered shape so as to be squeezed from one end part 11*b* toward the other end part 11*a*. In a similar way, the receive roll 12 has a tapered shape so as to be squeezed from one end part 12*b* toward the other end part 12*a*. The side surfaces of the receive rolls 11 and 12 (may be referred to as truncated cone side surfaces) are inclined to the respective axes at a predetermined taper angle, which is similar to the side surface of the push roll 10. The receive rolls 11 and 12 are aligned with each other with a predetermined interval therebetween. The receive rolls 11 and 12 are fixed so that the axes of the receive rolls 11 and 12 are located in predetermined positions. Further, while the edge of the other end part 11*a* is shown to extend beyond the edge of one end part 11*b* on the ZX plane in FIGS. 3, 5, and 8, the edge of the other end part 11*a* and the edge of one end part 11*b* may accord with each other on the ZX plane. Similarly, while the edge of the other end part 12*a* extends beyond the edge of one end part 12*b* on the ZX plane, the edge of the other end part 12*a* and the edge of one end part 12*b* may accord with each other.

The bearing housing 13 is arranged on one end part 10*b* of the push roll 10 and the bearing housing 14 is arranged on the other end part 10*a* of the push roll 10. Further, the bearing housings 13 and 14 are respectively supported by the hydraulic cylinders 16 and 17 so that the bearing housings 13 and 14 can be vertically moved.

The hydraulic cylinders 16 and 17 are arranged below the bearing housings 13 and 14, respectively. The hydraulic cylinders 16 and 17 adjust a push-in amount by the push roll 10 via the bearing housings 13 and 14, respectively. The push-in amount means a distance from the lowermost part of the push roll 10 when the height of the lowermost part of the push roll 10 is equal to the height of the uppermost part of the receive roll 11 to the lowermost part of the push roll 10 when the push roll 10 is lowered (hereinafter, the push-in amount may be referred to as a push-in distance). The hydraulic cylinders 16 and 17 are able to change the push-in amount by the push roll 10 during a bending process so that the push-in distance of the push roll 10 changes according to the position of the workpiece. The hydraulic cylinders 16 and 17 may adjust the push-in amount by the push roll 10 by using, for example, a hydraulic controller 18 (may be referred to as a controller) that controls the amount of oil that flows through the hydraulic cylinders 16 and 17.

Figure 4:
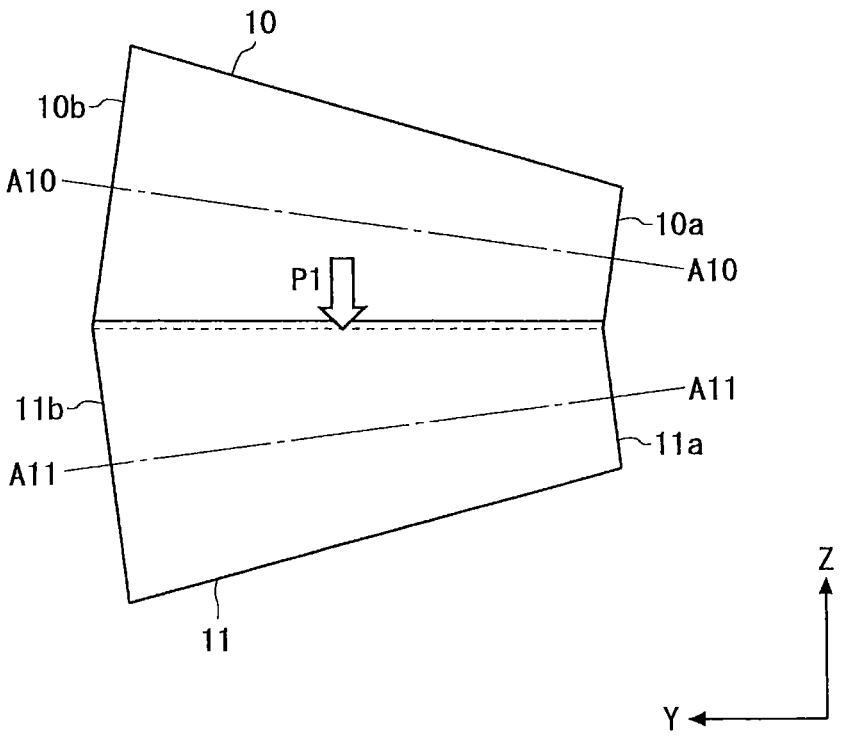
Figure 5:
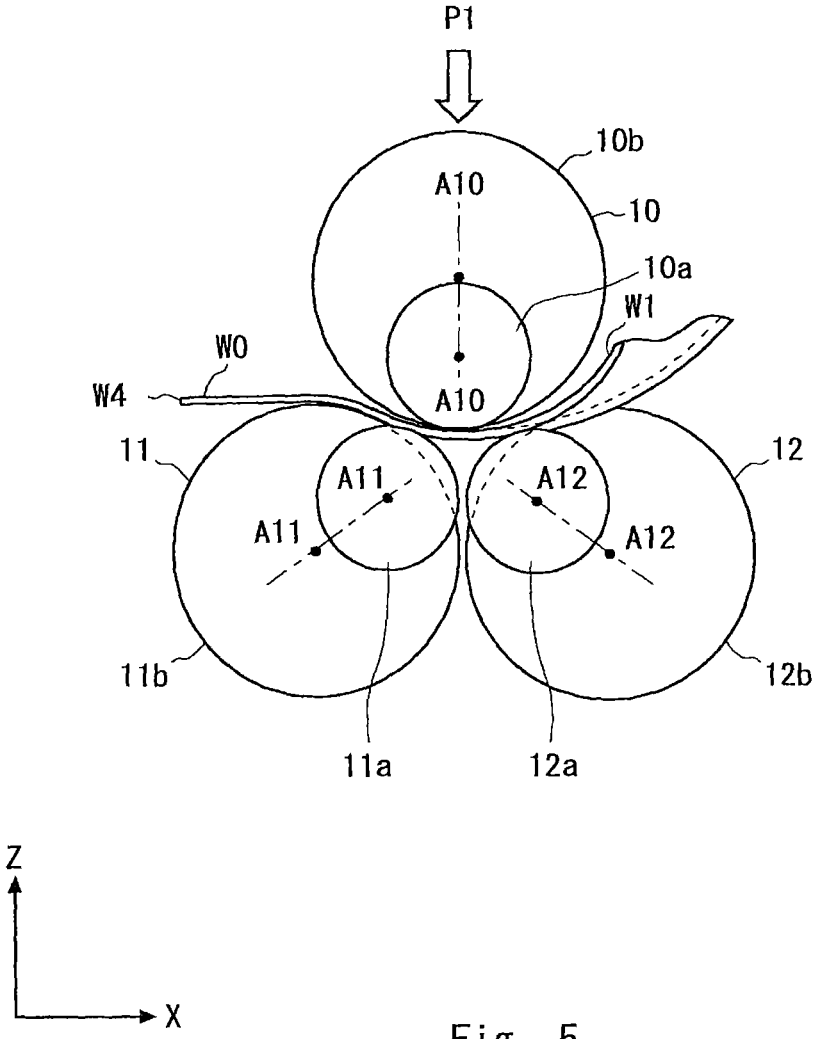

Next, the manufacturing method according to the first embodiment will be described. As shown in FIGS. 1, 4, and 5, the push roll 10 is pushed toward the receive rolls 11 and 12 while allowing a trapezoidal plate shape workpiece W0 to pass between the push roll 10 and the receive rolls 11 and 12 to perform roll bending (side part forming process S1). The workpiece W0 is a trapezoidal plate made of a material which can be roll-bended. The materials which can be roll-bended include, for example, a metallic material such as stainless steel. The workpiece W0 includes an upper base part W1 corresponding to the upper base of the trapezoid, a lower base part W2 corresponding to the lower base of the trapezoid, and leg parts W3 (FIG. 3) and W4 corresponding to the legs of the trapezoid. The lower base part W2 of the trapezoid corresponds to the side longer than that of the upper base part W1.

Typically, roll bending is performed so that the lower base part W2 passes through the side of one end part 10*b* while allowing the upper base part W1 of the workpiece W0 to pass through the side of the other end part 10*a*. The push roll 10 pushes the workpiece W0 at a predetermined push-in amount P1 while the workpiece W0 passes between the push roll 10 and the receive rolls 11 and 12. A side part 20*a* (see FIGS. 10 and 11) having a curvature R1 is thus formed.

Figure 6:
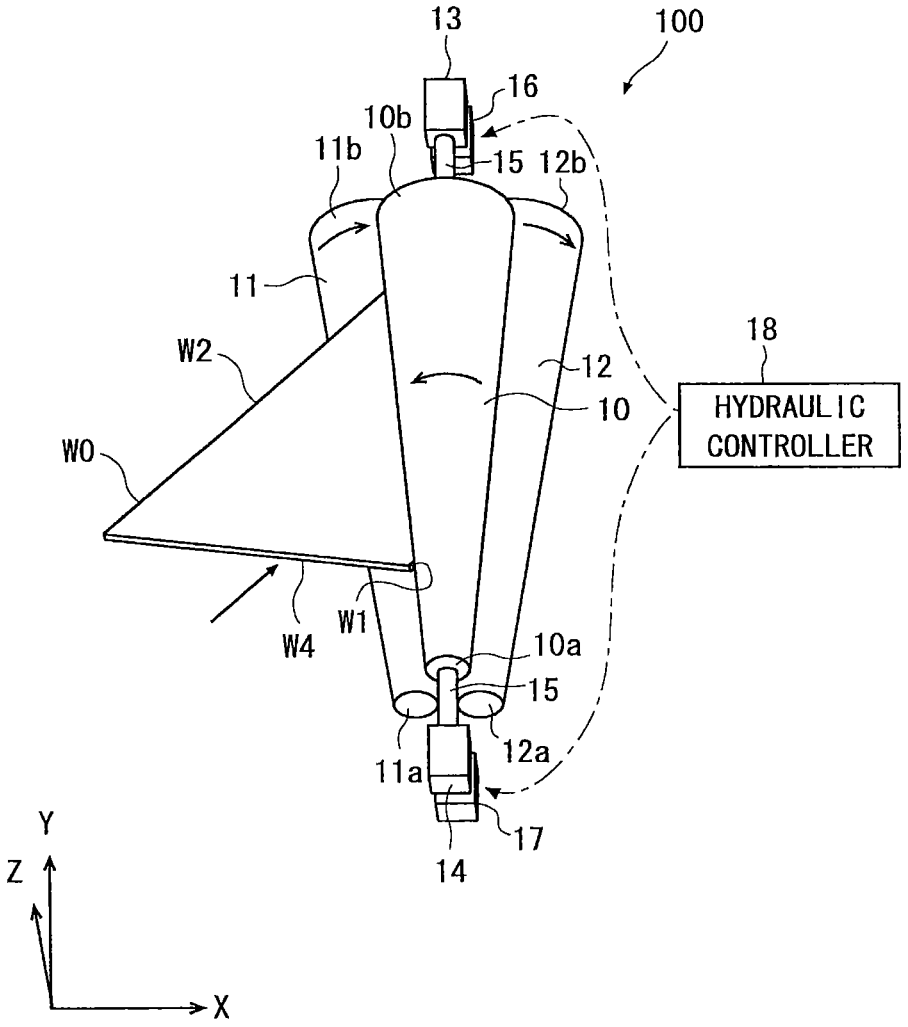
Figure 7:
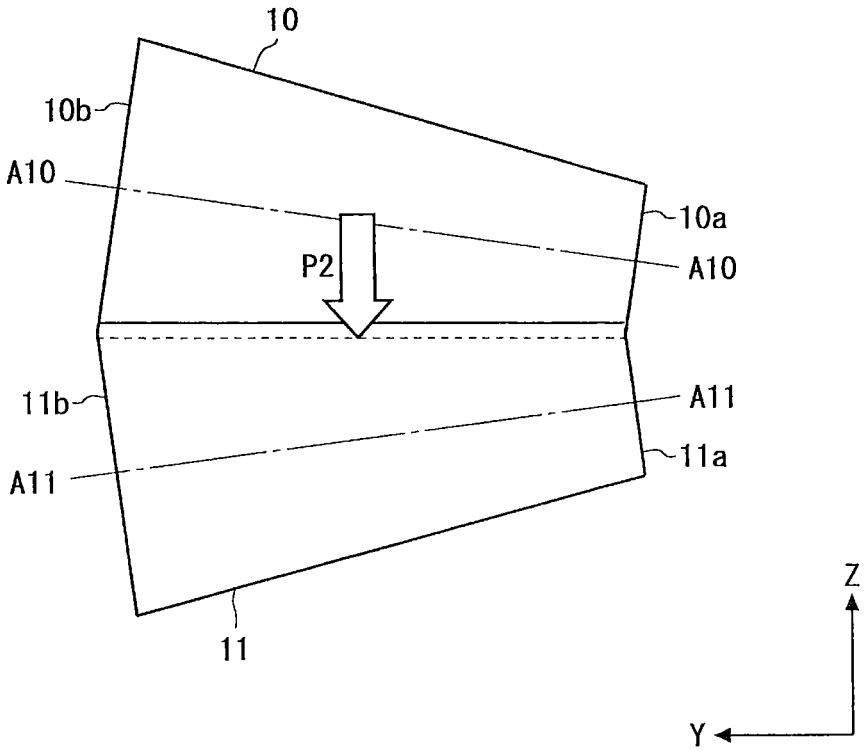
Figure 8:
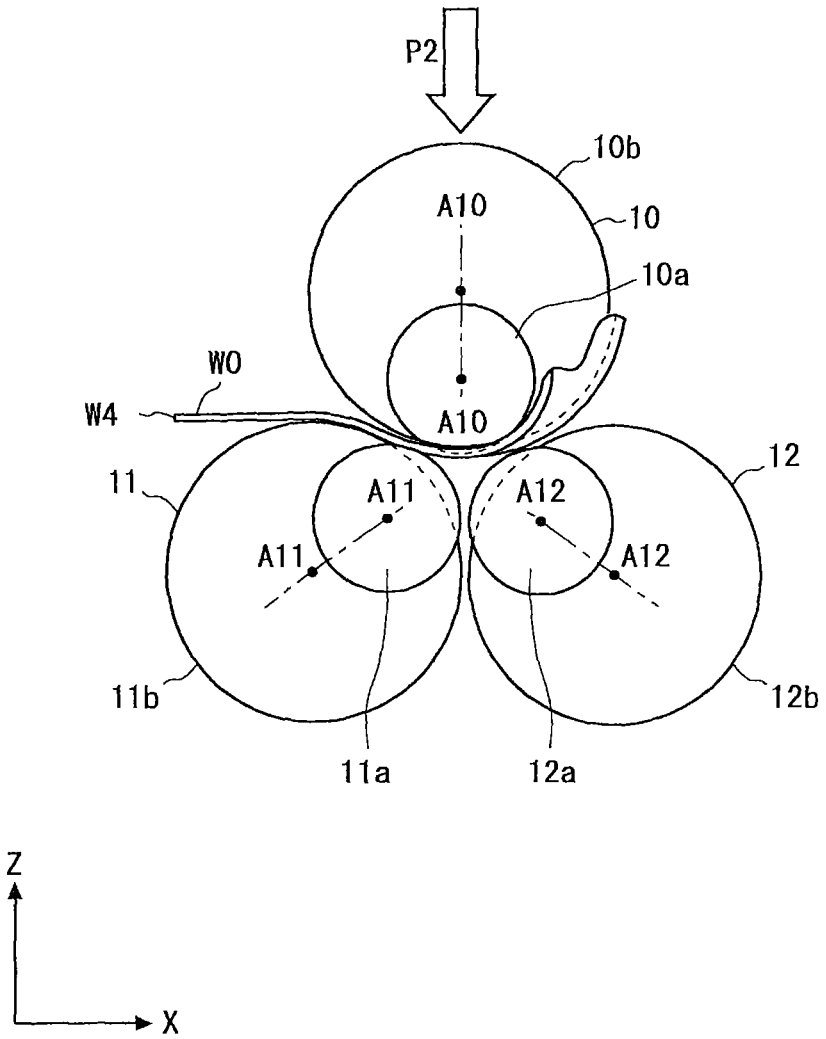

Subsequently, as shown in FIGS. 6 to 8, the push roll 10 pushes the workpiece W0 at a push-in amount P2 which is larger than the push-in amount P1 while allowing the trapezoidal plate shape workpiece W0 to pass between the push roll 10 and the receive rolls 11 and 12 (corner part forming process S2). A corner part 20*f* (see FIGS. 10 and 11) having a curvature R2 is thus formed. As shown in FIG. 9, a curvature R of the bent formed product produced by the roll bending device may be, for example, proportional to a push-in amount L by the push roll. In such a case, due to the drop of the push roll 10, the corner part 20*f* is formed by being pressed at a push-in amount larger than that when the side part 20*a* is formed. Thus the curvature R2 of the corner part 20*f* is larger than the curvature R1 of the side part 20*a*. The curvature R2 is preferably large since the large curvature makes the corner part 20*f* sharper.

Next, the side part forming process S1 and the corner part forming process S2 are alternated until the time that the leg part W3 and the leg part W4 face each other or come in contact with each other. As shown in FIG. 10, the workpiece W0 is formed into a tapered cylindrical-shaped body 20 having a polygonal cross-sectional shape. The term "polygonal shape" in this specification not only means a completely polygonal shape but also means, for example, a substantially polygonal shape in which some or all of the corner parts are somewhat rounded or cut off or side parts have a predetermined curvature. As shown in FIGS. 10 and 11, the cylindrical-shaped body 20 includes side parts 20*b*, 20*c*, 20*d*, and 20*e* and corner parts 20*g*, 20*h*, and 20*i*. The side parts 20*a*, 20*b*, 20*c*, 20*d*, and 20*e* correspond to the sides of the polygon in the cross section of the cylindrical-shaped body 20, and the corner parts 20*f*, 20*g*, 20*h*, and 20*i* correspond to the corner parts of the polygon in the cross section of the cylindrical-shaped body 20. End parts 23 and 24 correspond to the leg parts W3 and W4, respectively. The curvature and the length of the side parts 20*a*, 20*b*, 20*c*, 20*d*, and 20*e* and the corner parts 20*f*, 20*g*, 20*h*, and 20*i* may be different from each other, and the curvature may be changed by changing the push-in amount. The upper base part W1 corresponds to one end part 21 of the cylindrical-shaped body 20 and the lower base part W2 corresponds to the other end part 22 of the cylindrical-shaped body 20. The cylindrical-shaped body 20 has a tapered shape so as to be squeezed to one end part 21 from the other end part 22.

Now, a relation among the dimension of the formed product, the roll diameter, and the push-in amount will be described. As shown in FIG. 12, the radius corresponding to the curvature R of the cylindrical-shaped body 20 as a formed product is represented as rf, the radius of the receive roll 12 is represented as r12, and the distance between the receive roll 11 and the receive roll 12 is represented as c. As shown in FIG. 13, the position of the lowermost part of the push roll 10 when the height of the lowermost part of the push roll 10 is equal to the height of the uppermost part of the receive roll 11 is represented by an origin O1. A push-in amount b to a lowermost part O2 of the push roll 10 when the push roll 10 is lowered corresponds to the distance from the origin O1 to the lowermost part O2 of the push roll 10 when the push roll 10 is lowered. As shown in FIG. 12, by connecting a center C1 of the circle for the radius rf, a midpoint C3 of the axis A11 and the axis A12, and the axis A11, a right-angled triangle C1C3A12 is formed. By using the Pythagorean theorem for the right-angled triangle C1C3A11, the radius rf of the dimension of the formed product, the radius r12 of the roll, and the push-in amount b are expressed by the following Expression 1.

$$(rf+r12)2=(r12+c/2)2+\{(rf+r12)-b\}2 \quad \text{(Expression 1)}$$

Solving Expression 1 for rf obtains Expression 2.

$$(rf+r12)2=r122+r12c+c2/4+(rf+r12)2-2b(rf+r12)+b2$$

$$0=r122+r12c+c2/4-2b(rf+r12)+b2$$

$$2brf=r122+r12c+c2/4-2r12b+b2$$

$$rf=\{(r12-b)2+r12c+c2/4\}/2b \quad \text{(Expression 2)}$$

The radius rf of the formed product can be approximated by Expression 2. According to Expression 2, the radius rf of the formed product is influenced by the radius r12 of the receive roll 12, the push-in amount b, and the distance c. In a similar way, the radius rf of the formed product is also influenced by the radius of the receive roll 11. Accordingly, in order to adjust the radius rf of the formed product, the receive rolls 11 and 12 may be respectively moved in the β-x direction (see FIG. 3) and the γ-x direction, for example, to change the distance c. By taking into consideration the plate thickness and the material properties of the workpiece W0, and the influence of the friction among the workpiece W0, the push roll 10, and the receive rolls 11 and 12, it is possible to calculate the radius rf of the cylindrical-shaped body 20 more accurately.

Next, the end part 23 of the cylindrical-shaped body 20 and the end part 24 of the cylindrical-shaped body 20 may be welded together (welding process S3). By welding together the end part 23 and the end part 24, it is possible to form the cylindrical-shaped body which has no seam in the circumferential direction.

By changing the push-in amount in each of the side part forming process S1 and the corner part forming process S2 and the number of times that these processes are repeated, the plate-shape workpiece W0 can be formed into cylindrical bodies having various cross-sectional shapes.

From the above description, according to the manufacturing method of the first embodiment, the cylindrical-shaped body having a polygonal cross-sectional shape can be formed. Further, in the manufacturing method according to the first embodiment, a roll bending device having a general configuration that includes a push roll and receive rolls is used, and the necessary equipment cost is low. Further, it is possible to change the push-in amount according to the position of the workpiece by the hydraulic cylinder or the hydraulic controller, for example. According to this configuration, it is possible to manufacture cylindrical-shaped bodies having various polygonal cross-sectional shapes with a low equipment cost using a device having a general configuration without using equipment such as a plurality of press dies to form various cross-sectional shapes.

Incidentally, by performing processing such as a diameter reducing process to reduce the end part of the cylindrical-shaped body obtained by the manufacturing method according to the first embodiment or arranging a duct which is a flow path of exhaust gas in the cylindrical-shaped body obtained by the manufacturing method according to the first embodiment, it is possible to obtain, for example, a sub-muffler. One example of such a sub-muffler is a sub-muffler 1 shown in FIG. 14. The sub-muffler 1 includes a cylindrical body 2 having a substantially trapezoidal cross-sectional shape, a separator 4, and a duct 3. The sub-muffler 1 is a separator-type sub-muffler including the separator 4. The cylindrical body 2 is obtained by processing the cylindrical-shaped body 20. The cylindrical body 2 includes a central part 29, an end part 21 extending in one side of the cylindrical body 2 from the central part 29, and an end part 22 extending in the other side thereof from the central part 29. The central part 29 has a substantially trapezoidal cross-sectional shape, and the cross-sectional profile has a decreasing diameter from the end part 21 to the end part 22. The central part 29 has a predetermined curvature about the axis of the cylindrical body 2, and has a high rigidity. The end part 21 and the end part 22 are obtained by performing processing such as pressing processing or spinning processing on the end part 21 (see FIG. 10) and the end part 22 (see FIG. 10) of the cylindrical-shaped body 20.

As shown in FIG. 15, the sub-muffler 1 is provided, for example, in the lower part of a floor surface 60 of the vehicle and is used. The floor surface 60 includes a concave part 61 recessed toward the vehicle interior and the cross-sectional shape of the concave part 61 is a trapezoidal shape. The cross-sectional shape of the cylindrical body 2 is a trapezoidal shape and the shape of the sub-muffler 1 corresponds to the shape of the concave part 61. Accordingly, the sub-muffler 1 is provided in the concave part 61 to fit inside the concave part 61, whereby it is possible to secure a large capacity.

Second Embodiment

Figure 16:
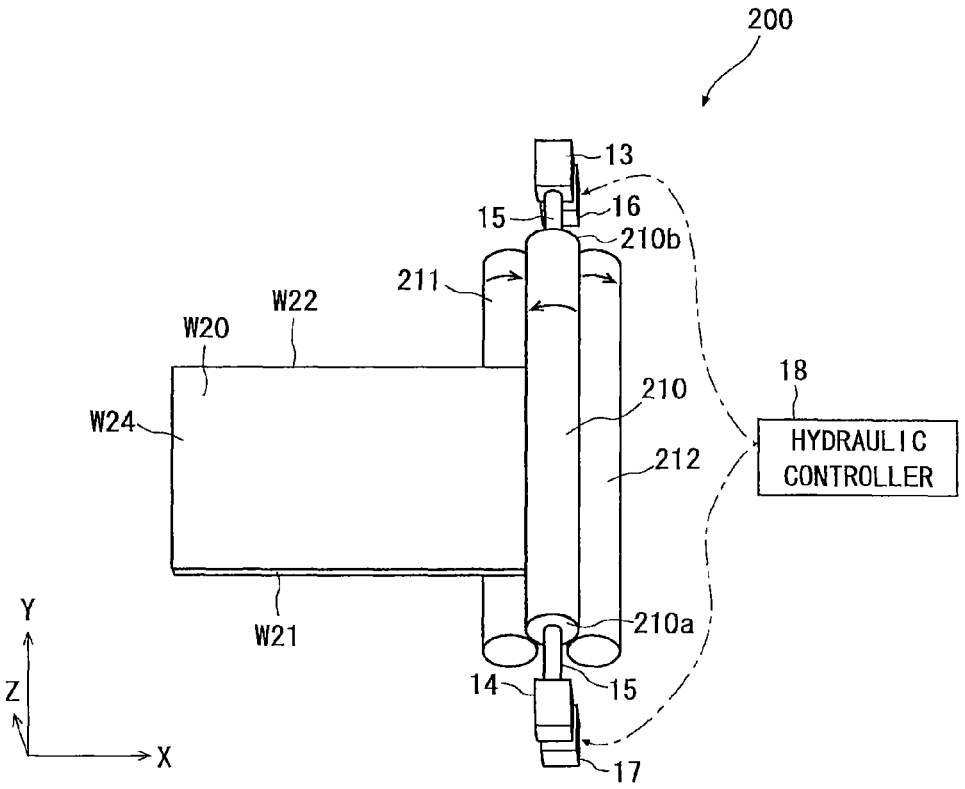
FIGS. 16 and 17 are schematic views showing processes of a manufacturing method according to a second embodiment.
Figure 17:
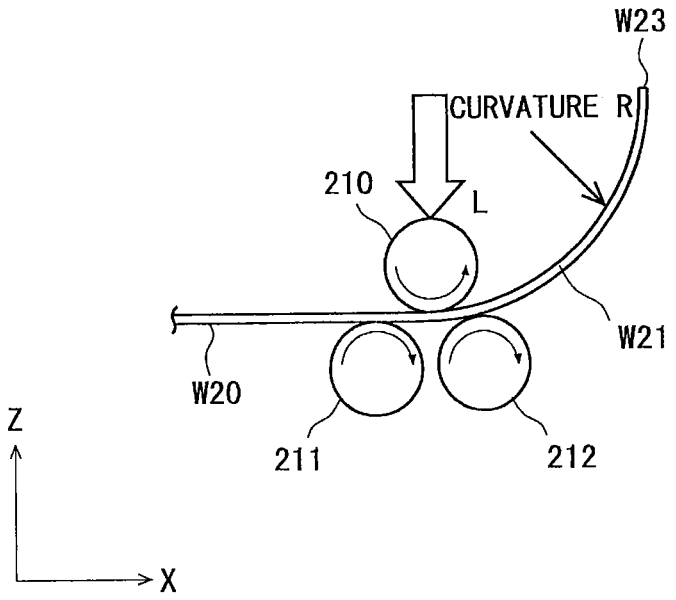
Figure 18:
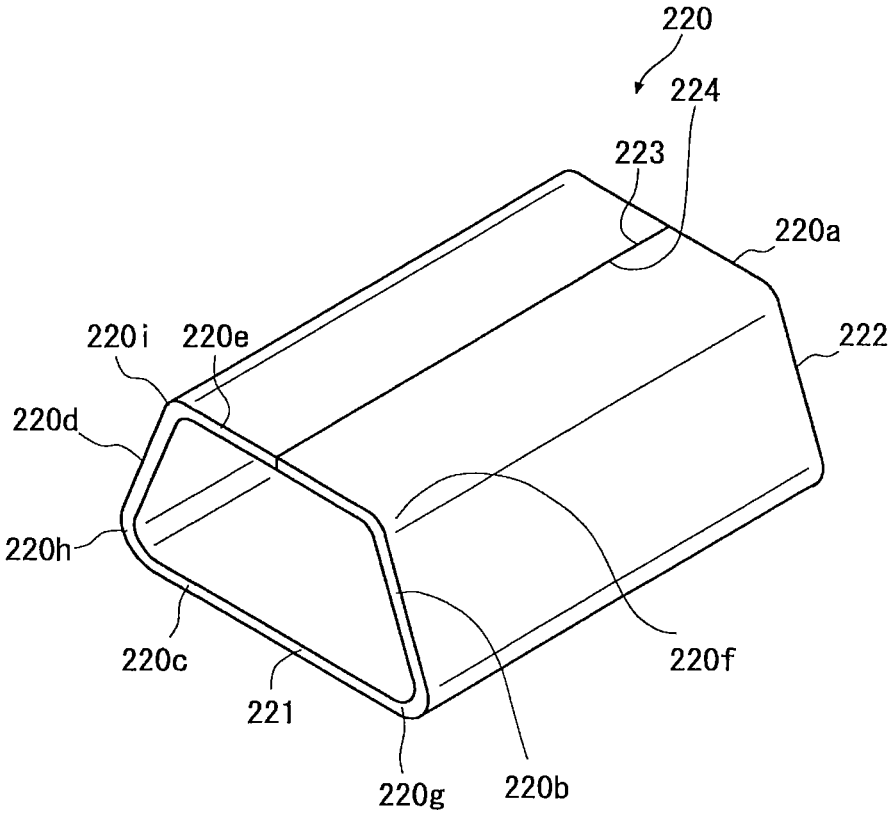
FIG. 18 is a perspective view of a cylindrical-shaped body.
Figure 19:
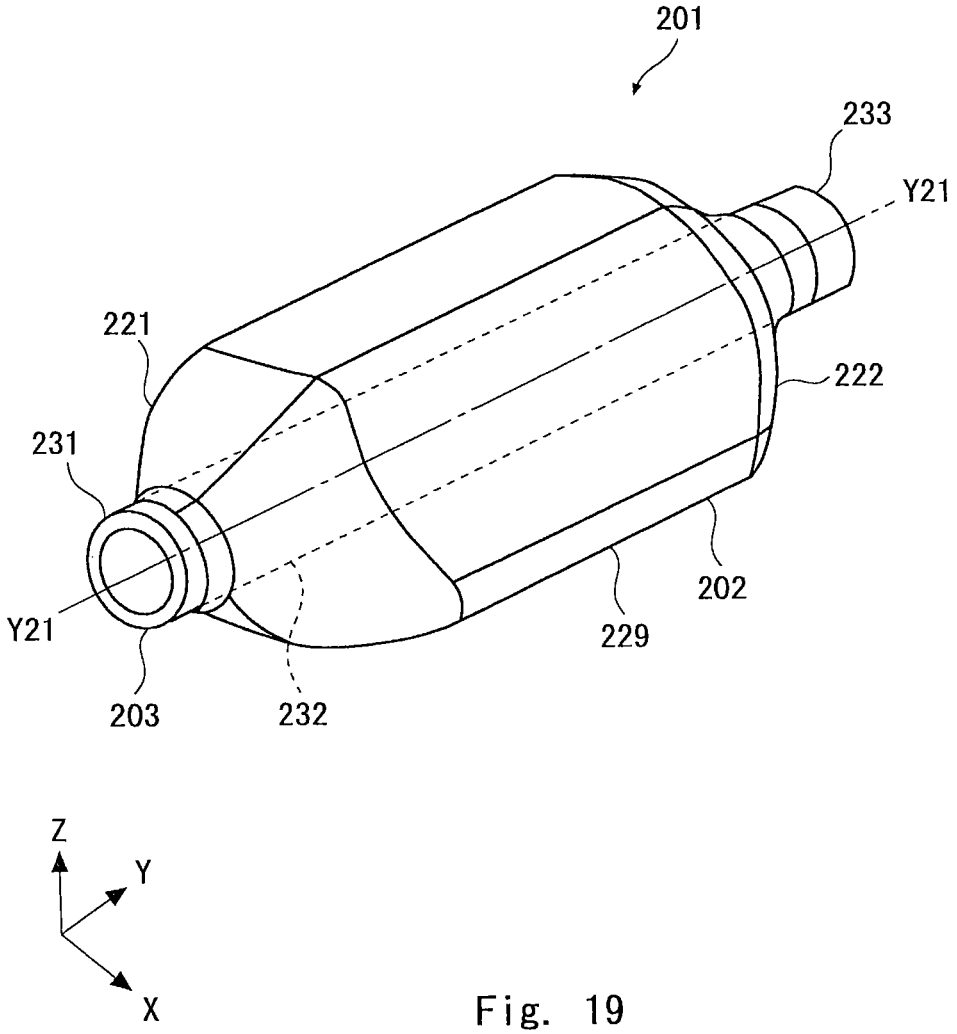
FIG. 19 is a perspective view of a sub-muffler.
Figure 20:
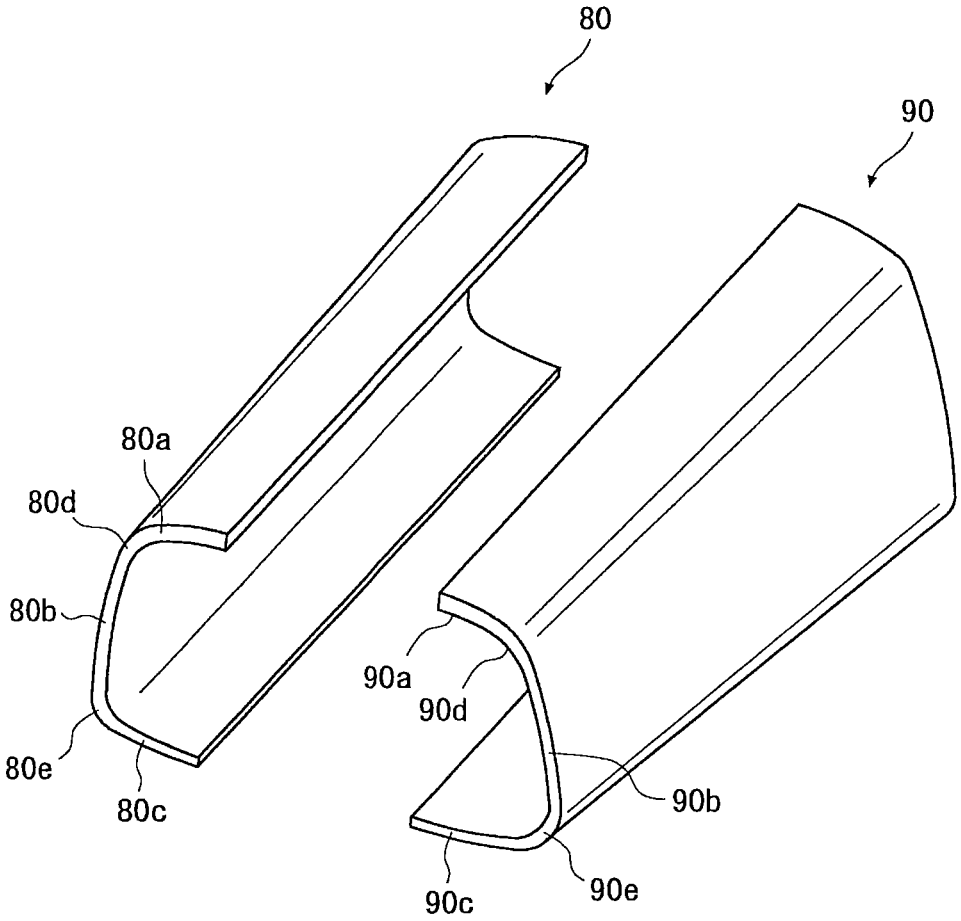
FIG. 20 is a perspective view of two plates formed using a press die.

With reference to FIGS. 16-19, a manufacturing method according to a second embodiment will be described. FIGS. 16 and 17 are schematic views showing processes of the manufacturing method according to the second embodiment. FIG. 18 is a perspective view of a cylindrical-shaped body. FIG. 19 is a perspective view of a sub-muffler. In FIG. 17, the bearing housings 13 and 14 and the hydraulic cylinders 16 and 17 are not shown for the sake of clarity of the drawing.

First, a manufacturing device used in the manufacturing method according to the second embodiment will be described. The manufacturing device used in the manufacturing method according to the second embodiment includes the same configurations as those of the roll bending device 100 except for the configurations of the push roll and the receive rolls. Elements of this embodiment which are the same as those of the first embodiment are denoted by the same reference symbols as those of the first embodiment and the descriptions thereof will be omitted.

As shown in FIGS. 16 and 17, a roll bending device 200 includes a push roll 210 and receive rolls 211 and 212.

The push roll 210 is a columnar body that is supported by the bearing housings 13 and 14 via the axial member 15 and can be rotated around the axis. The side surface of the push roll 210 (may be referred to as a column side surface) is substantially parallel to the axis. That is, the push roll 210 has a straight shape, not a tapered shape, and has a taper angle of about 0°. The push roll 210 is vertically moved by the hydraulic cylinders 16 and 17 via the bearing housings 13 and 14 and the axial member 15. The push roll 210 can be lowered, for example, toward the receive rolls 211 and 212.

The receive rolls 211 and 212 are columnar bodies that are supported by a supporting base (not shown) via an axial member (not shown) and can be rotated around an axis. The side surfaces of the receive rolls 211 and 212 (may be referred to as column side surfaces) are parallel to the axis, which is similar to the side surface of the push roll 210. In summary, the receive rolls 211 and 212 do not have a tapered shape and the taper angle is substantially 0°. The receive rolls 211 and 212 are aligned with each other with a predetermined interval therebetween. The receive rolls 211 and 212 are fixed so that the axes of the receive rolls 211 and 212 are located in predetermined positions.

The hydraulic cylinders 16 and 17 adjust the push-in amount by the push roll 210 via the bearing housings 13 and 14, respectively. The hydraulic cylinders 16 and 17 can change the push-in amount by the push roll 10 during the forming process so that the push-in distance of the push roll 210 changes depending on the position of the workpiece.

Next, the manufacturing method according to the second embodiment will be described. First, similar to the manufacturing method according to the first embodiment, roll bending is performed by pushing the push roll 210 toward the receive rolls 211 and 212 while allowing a trapezoidal plate shape workpiece W20 to pass between the push roll 210 and the receive rolls 211 and 212 (side part forming process S21). The workpiece W20 is a rectangular plate made of a material which can be roll-bended. The workpiece W20 includes short-side parts W23 and W24 corresponding to the short sides of the rectangle and long-side parts W21 and W22 corresponding to the long sides of the rectangle. When the workpiece W20 passes between the push roll 210 and the receive rolls 211 and 212, the push roll 210 pushes the workpiece W20 at a predetermined push-in amount P1. A side part 220*a* (see FIG. 18) having a curvature R1 is thus formed.

Next, the push roll 210 pushes the workpiece W20 at a push-in amount P2 which is larger than the push-in amount P1 while allowing the workpiece W20 to pass between the push roll 210 and the receive rolls 211 and 212 (corner part forming process S22). A corner part 220*f* (see FIG. 18) having a curvature R2 is thus formed. As shown in FIG. 9, for example, the curvature R of the bent formed product produced by the roll bending device may be proportional to the push-in amount L by the push roll. In such a case, due to the drop of the push roll 210, the corner part 220*f* is formed by being pressed at a push-in amount larger than that when the side part 220*a* is formed. Therefore, the corner part 220*f* has a curvature larger than the curvature R1 of the side part 220*a*. The curvature R2 is preferably large since the large curvature R2 makes the corner part 220*f* sharper.

Next, the side part forming process S21 and the corner part forming process S22 are alternated until the time that the short-side parts W23 and W24 face each other or come in contact with each other. As shown in FIG. 18, side parts 220*b*, 220*c*, 220*d*, and 220*e* and corner parts 220*g*, 220*h*, and 220*i* are formed in the workpiece W20. Further, as shown in FIG. 18, the workpiece W0 is formed into a straight cylindrical-shaped body 220 having a polygonal cross-sectional shape without having a taper angle. The side surface of the cylindrical-shaped body 220 is parallel to the axis. The side parts 220*a*, 220*b*, 220*c*, 220*d*, and 220*e* correspond to the sides of the polygon in the cross section of the cylindrical-shaped body 220, and the corner parts 220*f*, 220*g*, 220*h*, and 220*i* correspond to the corner parts of the polygon in the cross section of the cylindrical-shaped body 220. The curvature and the length of the side parts 220*a*, 220*b*, 220*c*, 220*d*, and 220*e* and the corner parts 220*f*, 220*g*, 220*h*, and 220*i* may be different from each other.

Further, while the side part forming process S21 and the corner part forming process S22 are alternated in the manufacturing method according to the second embodiment, the push-in amount P1 in the side part forming process S21 may be 0 (zero). When the push-in amount P1 in the side part forming process S21 is 0 (zero), the curvature R of the side parts 220*a*, 220*b*, 220*c*, 220*d*, and 220*e* becomes 0 and the shape of the side parts 220*a*, 220*b*, 220*c*, 220*d*, and 220*e* becomes flat.

As seen from the above description, according to the manufacturing method of the second embodiment, the cylindrical body having a polygonal cross-sectional shape can be formed. Further, in the manufacturing method according to the second embodiment, the push-in amount can be changed depending on the position of the workpiece using a roll bending device having a general configuration that includes a push roll and receive rolls. Accordingly, it is possible to manufacture cylindrical-shaped bodies having polygonal cross-sectional shapes by only using a device having a general configuration without using equipment such as a plurality of press dies to form various cross-sectional shapes.

Incidentally, by performing processing such as a diameter reducing process to reduce the end part of the cylindrical-shaped body 220 obtained by the manufacturing method according to the second embodiment or arranging a duct which is a flow path of exhaust gas in the cylindrical-shaped body 220 obtained by the manufacturing method according to the second embodiment, it is possible to obtain, for example, a sub-muffler. One example of such a sub-muffler is a sub-muffler 201 shown in FIG. 19. The sub-muffler 201 includes a cylindrical body 202 (may be referred to as a sub-muffler outer cylinder) having a substantially trapezoidal cross-sectional shape and a duct 203. The cylindrical body 202 is obtained by processing the cylindrical-shaped body 220. The cylindrical body 202 includes a central part 229, an end part 221 extending in one side of the cylindrical body 202 from the central part 229, and an end part 222 extending in the other side thereof from the central part 229. The central part 229 has a substantially trapezoidal cross-sectional shape and the cross-sectional shape is substantially constant from the side of the end part 221 to the end part 222. The central part 229 has a predetermined curvature about the axis of the cylindrical body 202 and has a high rigidity. The end part 221 and the end part 222 are obtained by performing processing such as pressing processing or spinning processing on one end part 221 and the other end part 222 (see FIG. 18) of the cylindrical-shaped body 220. The sub-muffler 201 can be provided, similar to the sub-muffler 1, in the concave part 61 to fit inside the concave part 61 of the floor surface 60 of the vehicle (see FIG. 15). Therefore, it can be ensured that the sub-muffler 201 has a large capacity, which is similar to the sub-muffler 1.

Note that the present invention is not limited to the above first and second embodiments and may be changed as appropriate without departing from the spirit of the present invention. For example, while the push roll 10 is pushed toward the two receive rolls 11 and 12 in the manufacturing method according to the first and second embodiments, the two receive rolls 11 and 12 may instead be pushed toward the push roll 10. Further, the order of the side part forming process S1 or S21 and the corner part forming process S2 or S22 or the number of times that these processes are repeated can be changed as appropriate. Further, the roll bending device used in the manufacturing method according to the first and second embodiments may further include a roll opposed to the push roll 10 on the side of the two receive rolls 11 and 12. Further, while the roll bending device according to the first embodiment uses the hydraulic cylinders 16 and 17 to push the push roll, an actuator (or it may be referred to as a drive part) may be used in place of the hydraulic cylinders. Such an actuator may include, for example, a hydraulic motor. Further, while the trapezoidal plate shape workpiece W0 is used in the manufacturing method according to the first embodiment, a fan plate shape workpiece may be used instead. Further, while the workpiece is passed between the push roll and the receive rolls once in the manufacturing method according to the first and second embodiments, the workpiece may be passed between them a plurality of times.

Further, in the manufacturing method according to the first embodiment, by changing the combination of the push-in amount by the push roll 10 (see FIG. 1) in one end part 10*b* and the push-in amount in the other end part 10*a*, cylindrical-shaped bodies having various taper angles can be manufactured. It is thus possible to change the taper angle of the cylindrical-shaped body obtained by forming the workpiece.

Further, while the taper angle of the formed product is determined by the taper angle of the push roll 10 or the receive rolls 11 and 12 in the manufacturing method according to the first embodiment, a resistance may be given to a part near the upper base part W1 or a part near the lower base part W2 of the workpiece W0 by a roller or a weight to slide the workpiece and the push roll or the receive roll to change the speed at which the workpiece W0 passes in one end part 10*b* or the other end part 10*a* having a diameter smaller than that of one end part 10*b*. It is therefore possible to change the taper angle of the cylindrical-shaped body obtained by forming the workpiece.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A manufacturing method of a sub-muffler outer cylinder, the manufacturing method comprising:

inserting a trapezoidal plate-shape workpiece having an upper base part and a lower base part between one push roll and two receive rolls; and pushing the one push roll toward the two receive rolls to bend the trapezoidal plate-shape workpiece, wherein a resistance is given to a part near the upper base part or a part near the lower base part of the workpiece by a roller or a weight to slide the workpiece and one of the push roll or the receive rolls to form the sub-muffler outer cylinder made of a cylindrical-shaped body having a tapered shape so as to be squeezed from a first end part to a second end part, wherein a push-in amount in a part of the workpiece corresponding to a corner part of the cylindrical-shaped body is made larger than a push-in amount in a part of the workpiece corresponding to a side part of the cylindrical-shaped body to form the cylindrical-shaped body having a polygonal cross-sectional shape, and wherein the push roll and the two receive rolls each have a truncated cone side surface.

* * * * *